US007018062B2

(12) United States Patent
Taylor

(10) Patent No.: US 7,018,062 B2
(45) Date of Patent: Mar. 28, 2006

(54) TUMBLER WITH LED

(75) Inventor: Philip G. Taylor, Lancashire (GB)

(73) Assignee: Patrick Ortiz, Las Vegas, NV (US)

( * ) Notice: Subject to any disclaimer, the term of this patent is extended or adjusted under 35 U.S.C. 154(b) by 0 days.

(21) Appl. No.: 10/847,706

(22) Filed: May 17, 2004

(65) Prior Publication Data

US 2004/0233661 A1 Nov. 25, 2004

Related U.S. Application Data

(60) Provisional application No. 60/472,639, filed on May 21, 2003.

(51) Int. Cl.
*F21V 33/00* (2006.01)

(52) U.S. Cl. ..... 362/101; 362/800; 362/802

(58) Field of Classification Search ..... 362/101, 362/253, 276, 800, 802
See application file for complete search history.

(56) References Cited

U.S. PATENT DOCUMENTS

| | | | | |
|---|---|---|---|---|
| 2,224,319 | A | | 12/1940 | Schroyer |
| 2,663,866 | A | | 12/1953 | Simpson |
| 2,745,947 | A | | 5/1956 | Sansous |
| 3,218,447 | A | * | 11/1965 | Pardue ..... 362/101 |
| 4,344,113 | A | | 8/1982 | Ditto et al. |
| 4,922,355 | A | | 5/1990 | Dietz et al. |
| 5,070,435 | A | | 12/1991 | Weller |
| 5,211,699 | A | | 5/1993 | Tipton |
| 5,624,177 | A | | 4/1997 | Rosaia |
| 5,743,620 | A | | 4/1998 | Rojas et al. |
| 5,879,068 | A | | 3/1999 | Menashrov et al. |
| 5,931,558 | A | | 8/1999 | Chen |
| 5,990,790 | A | | 11/1999 | Lusareta |
| 6,163,248 | A | * | 12/2000 | Paek et al. ..... 362/101 |
| 6,352,352 | B1 | | 3/2002 | Schletterer et al. |
| 6,419,384 | B1 | | 7/2002 | Lewis et al. |
| 6,511,196 | B1 | | 1/2003 | Hoy |
| 6,511,197 | B1 | | 1/2003 | Kalemjian |

OTHER PUBLICATIONS

Abstract of DE 10020173; Nov. 9, 2000; Rojko Josef.
Abstract of FR2803904; Jul. 20, 2001; Christophe et al.
Abstract of WO0210642; Feb. 7, 2002; Vanderschuit.

* cited by examiner

*Primary Examiner*—Stephen F Husar
(74) *Attorney, Agent, or Firm*—Law Offices of David L. Hoffman

(57) ABSTRACT

A tumbler for holding a liquid beverage, comprising a liquid holding portion having a flat opaque base with a domed light transmitting portion proximate the center thereof, means defining a bottom chamber with an area for indicia of branding, a circuit containing a battery for lighting an LED, a transistor switch, a resistor for desired impedance, and the LED, which is connected to the circuit and has a light emitting portion disposed in the dome, and wherein a portion of the base defines an amplifying lens. The bottom chamber is fixed to the liquid holding portion.

8 Claims, 4 Drawing Sheets

FIG. 1
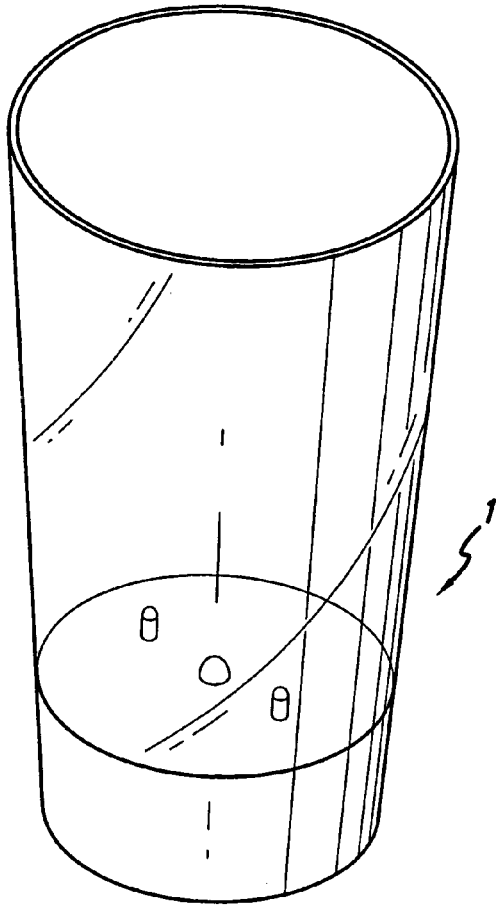
FIG. 8
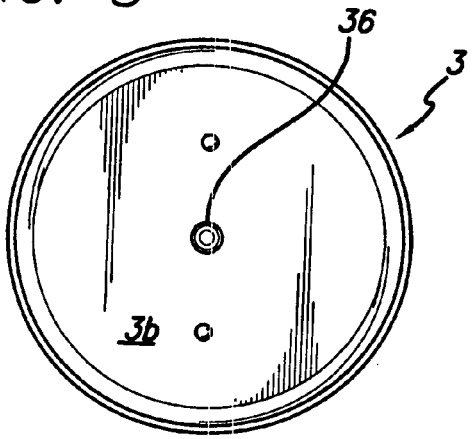
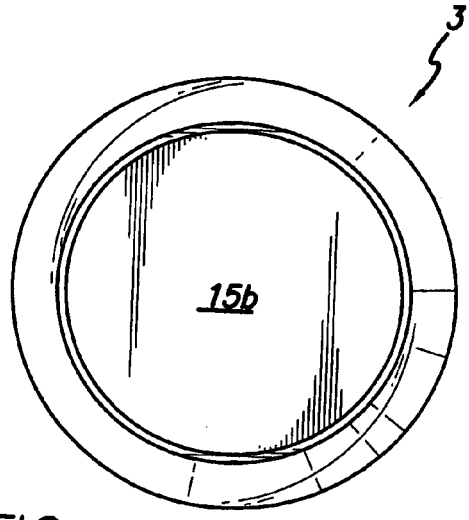
FIG. 9

TUMBLER WITH LED

CROSS REFERENCE TO RELATED APPLICATIONS

This application claims priority from U.S. Provisional Patent Application Ser. No. 60/472,639, filed on May 21, 2003, which is incorporated by reference herein.

BACKGROUND OF THE INVENTION

1. Field of the Invention

The present invention related to a lighted tumbler and more specifically a lighted tumbler using an LED or LEDs.

2. Description of the Related Art

The concept of a lighted beverage container is quite old. For example, U.S. Pat. No. 4,922,355 to Dietz et al discloses an illuminated beverage cup or mug having an incandescent bulb or lamp therein. The lamp is lit, in one embodiment, by using contacts that protrude into the beverage containing section, and the circuitry and lamp are housed in a base section below the beverage containing section. The bottom is threaded to the remainder of the cup. A domed wall is provided between the circuitry containing section or bottom section and the beverage containing section. The domed wall is light transmitting. The electrical circuit uses a battery to light the lamp. The circuit is activated by liquid in the container electrically connecting the contacts. The threaded connection, which necessitates an o-ring, is used so that the upper portion may be put in the dishwasher, and also for purposes for replacing the battery and/or bulb. One of the contacts is placed at the top of the domed wall so that when the beverage level is low, the contact will be uncovered. In another embodiment, the contacts are provided in a handle.

U.S. Pat. No. 5,743,620 to Rojas, et al discloses a sports bottle having a bulb which only partly extends into the liquid containing chamber. The wall separating the liquid chamber and the circuitry chamber has a central dome, but the entire wall is light transmitting. The purpose of the sports bottle with the light is to be brightly illuminated so as to help illuminate a bicycle rider at night. The drawings show a large battery. The light is activated by a push button at the bottom of the sports bottle. In addition, a top portion of the sports bottle is opaque so that the light will not bother the cyclist if looking at it.

BRIEF DESCRIPTION OF THE DRAWINGS

FIG. 1 is a top perspective view of a tumbler having an LED therein in accordance with one embodiment of the invention;

FIG. 8 is a top view of the tumbler of FIG. 1; and

FIG. 9 is a bottom view of the tumbler of FIG. 1.

DETAILED DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments also intended to be encompassed within the spirit and scope of the invention, e.g., the incorporation of a sound chip and holes to release the sound in the base.

Figure 2:
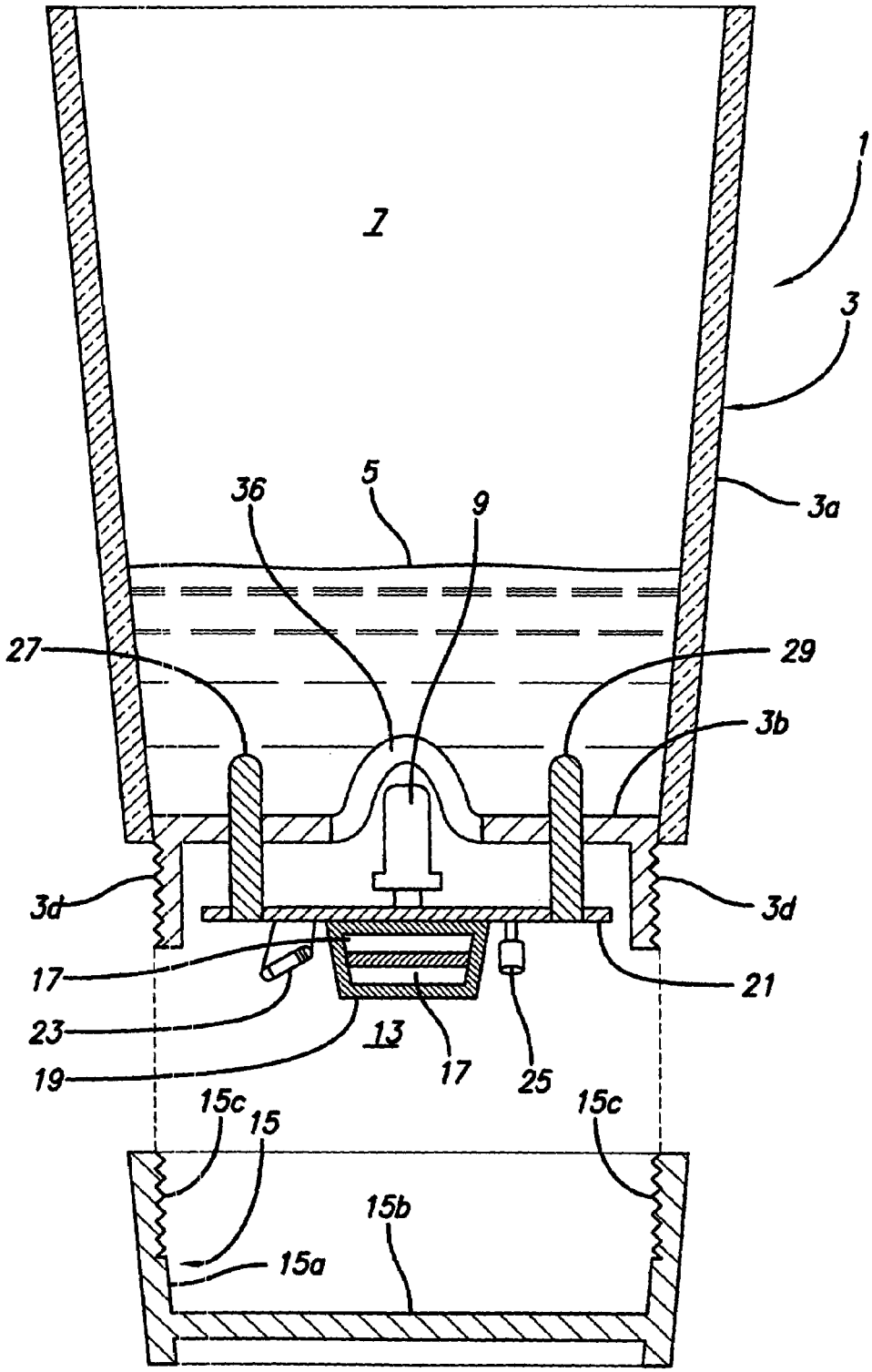
FIG. 2 is a partially exploded and partially sectioned side view of the tumbler of FIG. 1.

With reference to FIGS. 1 and 2, a tumbler 1 has a liquid holding portion 3 which includes side walls 3*a* and bottom wall 3*b*. Liquid 5 is disposed in liquid holding chamber 7.

Bottom wall 3*b* is preferably opaque except at a central portion 36, which is transparent or at least translucent. The tumbler is preferably plastic and most preferably SAN plastic, i.e., acrylylonitrile styrene. The central portion 36 essentially forms a lens, preferably a magnifying lens for an LED 9.

Figure 3:
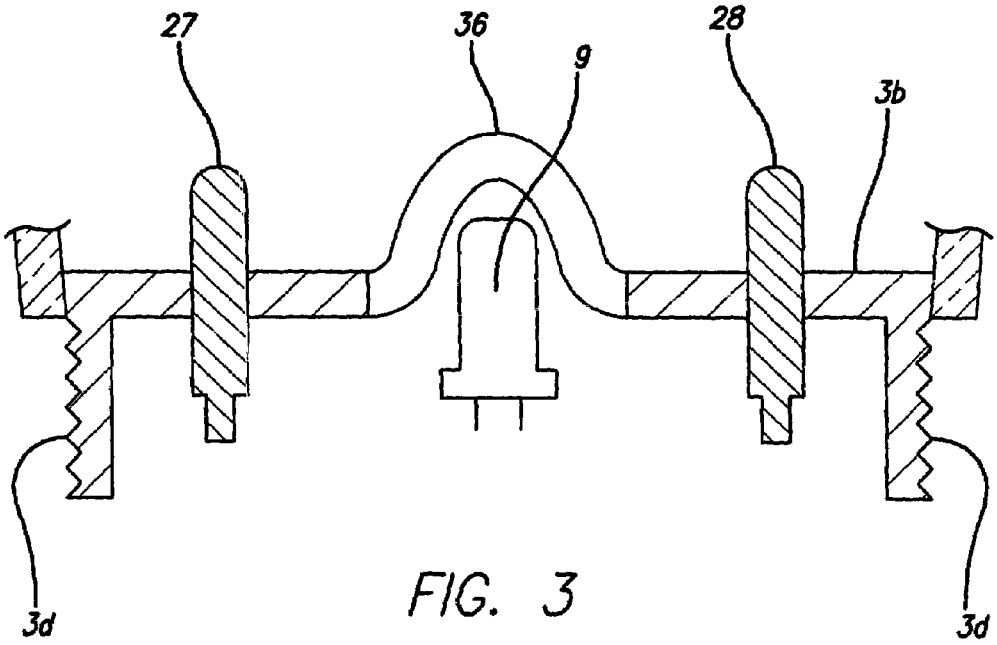
FIG. 3 is an enlarged partial sectional view of an LED and a bottom wall separating the beverage containing area of the tumbler from the LED and its associated circuitry.
Figure 4:
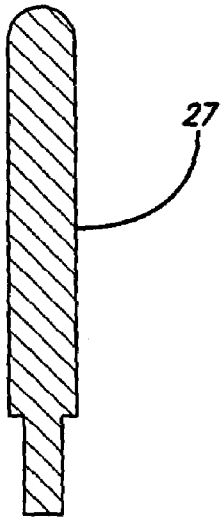
FIG. 4 is an enlarged side sectional view of a contact pin used in the tumbler.
Figure 5:
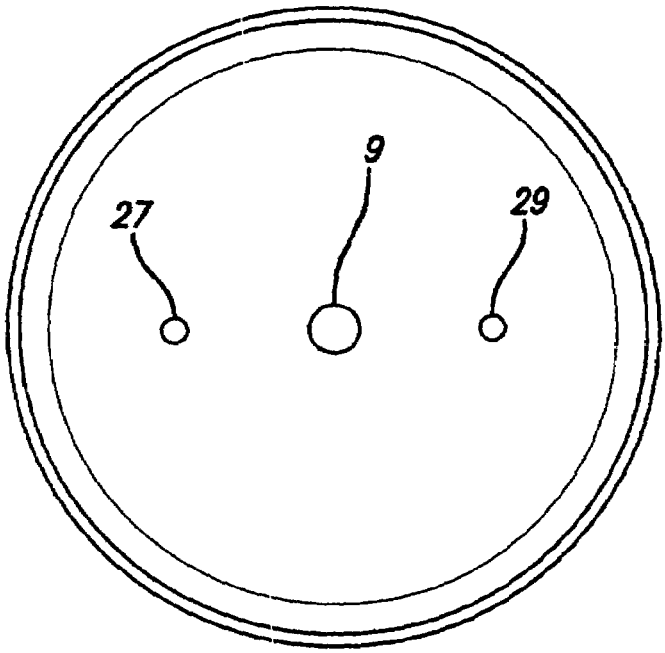
FIG. 5 is a schematic top view of the layout of the LED and contact pins in a preferred embodiment of the invention.
Figure 6:
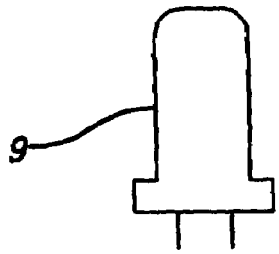
FIG. 6 is a side view of the LED light in a preferred embodiment of the invention.

As best shown in FIG. 3, LED 9 extends fully or substantially fully into the projection or lens formed by central portion 36. The bottom wall 3*b* is preferably flat, as noted above, except for the central portion 36. The LED has all or substantially all of its light emitting portion disposed in and above the plane in which bottom wall 3*b* lies. Preferably, at least half and more preferably at least two thirds of the light emitting portion of the LED is in or above the plane formed by bottom wall 3*b*. LED 9 is lit by means of a circuit primarily housed within a bottom portion 13 of the tumbler.

Bottom portion 13 comprises a bottom cap element 15 having side walls 15*a* and a bottom wall 15*b*. Bottom cap element 15 is preferably plastic and most preferably made of SAN. Preferably, bottom cap element 15 is interference welded to the member 3. Upper ends 15*c* of element 15 are stepped to mate with protruding portions 3*d* from the liquid holding portion 3. Preferably, the interference weld forms a water tight seal. It is also possible to thread the element 15 to the portion 3 or to otherwise removably affix the elements. However, in the preferred embodiment, the elements are welded or otherwise connected so as to form a unitary non-openable tumbler.

It is also possible to incorporate a hatch in the base for replacement of the batteries.

The circuitry includes a battery or batteries 17, preferably alkaline button cell batteries, e.g., L1142. The battery or batteries are held in a connection plate 19 which mechanically and electrically connects the batteries to the rest of the circuit formed on a printed circuit board (PCB) 21. A resistor 23 for providing a selected impedance is connected to the PCB and a transistor 25, preferably of an NPN type, is also connected to the PCB as a switch. Two contact pins 27, 29 provide connection to the PCB at one end inside bottom portion 13 and protrude through bottom wall 3*c* into liquid holding compartment 7.

Figure 7:
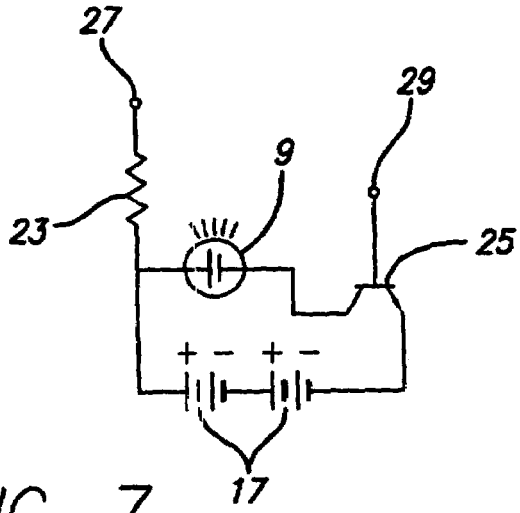
FIG. 7 is a circuit diagram in the preferred embodiment of the invention.

A circuit diagram is shown in FIG. 7. The contacts (or pins) 27 and 29 normally keep the circuit open. When a liquid 5 is disposed in the tumbler in liquid holding chamber 7, the pins are electrically connected by the liquid (assuming the liquid has ions in it, i.e., it is not distilled water). The batteries 17 will conduct from contact 27 to contact 29 and turn on transistor 25 by applying current to its base. The LED 9 connected to the collector or the emitter will then be electrically connected in a loop with the battery 17 as current will flow between the collector and emitter of transistor 25. Thus, transistor 25 functions as a switch.

Resistor 23 provides an impedance and its size determines, given a specific transistor, when the transistor will turn on. The battery 17 may be a 1.5 volt non-rechargeable LR43, as another example.

By using an LED, the batteries will not be used up quickly. In other words, the high efficiency of an LED will only use energy slowly, thereby providing a long life for the batteries. In addition, it is unlikely that an LED will burn out, even if the tumbler is dropped. Instead of one LED, multiple LEDs may be used and the single or multiple LEDs may have one color or multiple colors. If multiple LEDs are used, they may all be placed in the central portion 3*c*, or may each have an individual lens effect portion of the bottom wall 3*d*.

The lights also may be flashing. The lens effect is important particularly with the LED, as well as having the maximum possible portion of the LED protruding into the liquid holding chamber. Making the remainder of the bottom wall opaque assists not only in hiding the circuitry but also in channeling and focusing the light from the LED.

There may be a sound chip incorporated into the base with or without the LED with holes for the escape of the sound, one form of this is the promotional "Congratulations you have won."

The encapsulation of the LED in a dome while the remainder of the bottom wall is flat and opaque amplifies the LED light and thus makes the design suitable for use with an LED. The pins or terminals are spaced preferably in a manner to avoid the need for a dome. The electrical contact portion of the terminal extends above the bottom wall 3*c* sufficiently to also avoid the need for a dome.

The preferred interference or sonic welding provides a more secure leak proof connection of the bottom chamber to the rest of the tumbler, allowing it to be used in a dishwasher as a whole without disassembly. The LED is long lasting as it is typically 20 to 30 times more efficient than a bulb having a filament.

The lighted tumbler according to the invention may be assembled as follows:

1. Mold the top and bottom portions, preferably molding the top portion with the pins in place. This may be accomplished by putting the pins in the circuit board first and preferably connecting all of the other components to the circuit board, then molding the top portion of the tumbler.

2. The molded bottom portion is then mechanically connected to the top portion and sonic welded.

While the present invention has been described with regard to particular embodiments, it is recognized that additional variations of the present invention may be devised without departing from the inventive concept.

What is claimed is:

1. A tumbler for holding a liquid beverage, comprising:

a liquid holding portion having a flat opaque base with a domed light transmitting portion proximate the center thereof;

a bottom chamber;

a circuit disposed in the bottom chamber and containing a battery for lighting an LED and means for completing the circuit;

an LED connected to the circuit and having a light emitting portion disposed in the dome; and wherein the domed light transmitting portion of the base provides an amplifying lens and the bottom chamber is fixed to the liquid holding portion.

2. The tumbler of claim 1 wherein the bottom chamber and liquid holding portion each comprise plastic and are sonic welded together.

3. The tumbler of claim 1 wherein the means for completing the circuit comprises pins which extend into the liquid holding chamber so that the circuit will be closed in response to a liquid disposed in the liquid holding chamber.

4. The tumbler of claim 3 wherein the means for completing the circuit further comprises a resistor for impedance, and a switch for turning on the circuit in response to liquid disposed in the liquid holding chamber.

5. The tumbler of claim 1 wherein the LED has a light emitting portion which is at least half above the flat opaque base.

6. The tumbler of claim 5 wherein the light emitting portion is at least two thirds above the flat opaque base.

7. The tumbler of claim 2 wherein the bottom chamber comprises a flat area.

8. The tumbler of claim 1 wherein the LED and battery are sealed in the bottom chamber.

* * * * *